US005722843A

United States Patent [19]

Kerckhof et al.

[11] Patent Number: 5,722,843

[45] Date of Patent: Mar. 3, 1998

[54] PLUG CONNECTOR HOUSING ASSEMBLY

[75] Inventors: Bart Kerckhof, Oostkamp, Belgium; Artur Wohlfart, Bad Durkheim, Germany; Joris Dobbelaere, Beernem, Belgium; Josef Dirmeyer, Bodenwoehr, Germany; Rony Van Houdenhove, Ruiselede, Belgium

[73] Assignee: Siemens Aktiengesellschaft, Munich, Germany

[21] Appl. No.: 503,298

[22] Filed: Jul. 17, 1995

[30] Foreign Application Priority Data

Jul. 15, 1994 [DE] Germany ..... 9411509 U

[51] Int. Cl.[6] ..... H01R 13/62

[52] U.S. Cl. ..... 439/157; 439/372

[58] Field of Search ..... 439/152–160, 439/372

[56] References Cited

U.S. PATENT DOCUMENTS

| | | | |
|---|---|---|---|
| 4,152,038 | 5/1979 | Inouge et al. | 439/157 |
| 4,982,303 | 1/1991 | Krenz | 439/157 |
| 5,110,301 | 5/1992 | Inouye et al. | 439/157 |
| 5,322,448 | 6/1994 | Hahn | 439/157 |
| 5,391,086 | 2/1995 | Woller et al. | 439/157 |

FOREIGN PATENT DOCUMENTS 8714016 1/1988 Germany .

*Primary Examiner*—J. J. Swann

*Attorney, Agent, or Firm*—Herbert L. Lerner; Laurence A. Greenberg

[57] ABSTRACT

A plug connector housing assembly includes an outer housing and an inner housing to be nested together in a plug-in direction. The housings include sides having approximately parallel opposed side walls with inner and outer surfaces. The side walls of the outer housing define an insertion opening with a peripheral region. A locking mechanism in the form of a rack extends in the plug-in direction on one of the side walls. A lever is associated with another of the side walls. A shaft is perpendicular to the plug-in direction and associated with the lever. A gear wheel segment meshes with the rack, is firmly connected to the lever on the other of the side walls and is rotatably supported on the other of the side walls about the shaft. The rack and the gear wheel segment are disposed at least at one of the sides, between the inner wall surface of the outer housing and the opposite outer wall surface of the inner housing. The side wall carrying the rack in the peripheral region of the insertion opening, and the gear wheel segment, have complementary guide elements fitting into one another only at a predetermined angular position of the gear wheel segment in the plug-in direction, and preventing rotation of the gear wheel segment during engagement with the rack, until after attaining a predetermined insertion depth of the gear wheel segment.

4 Claims, 3 Drawing Sheets

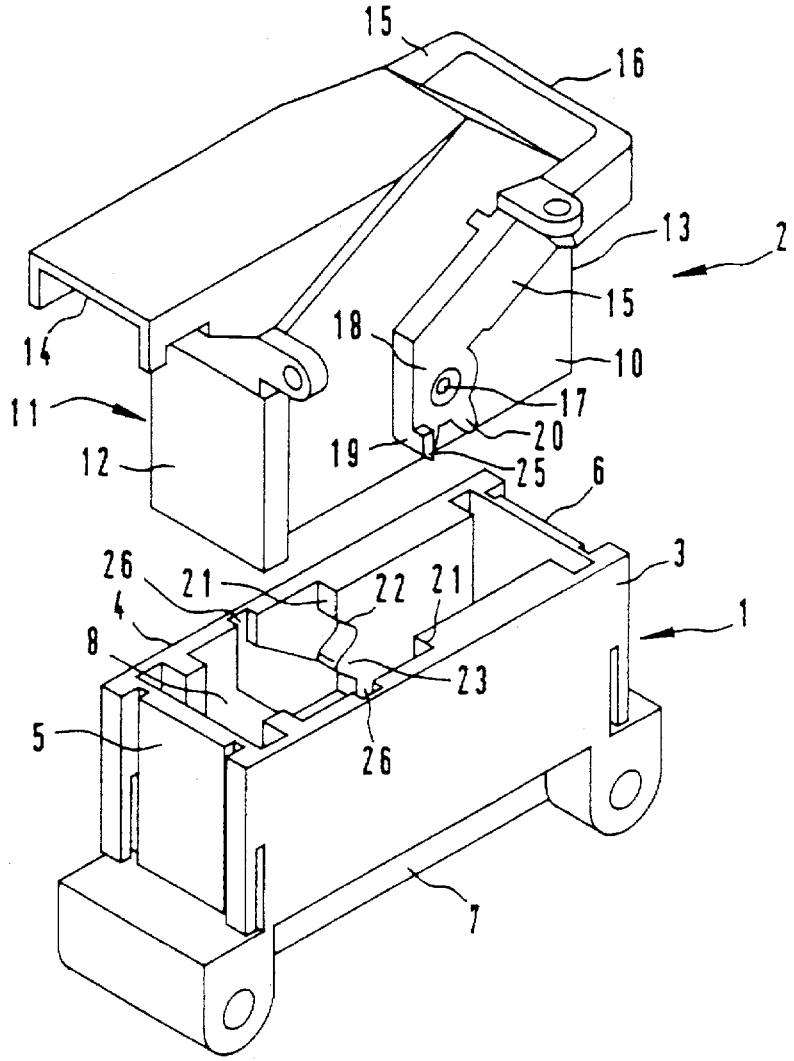
FIG 1
FIG 2
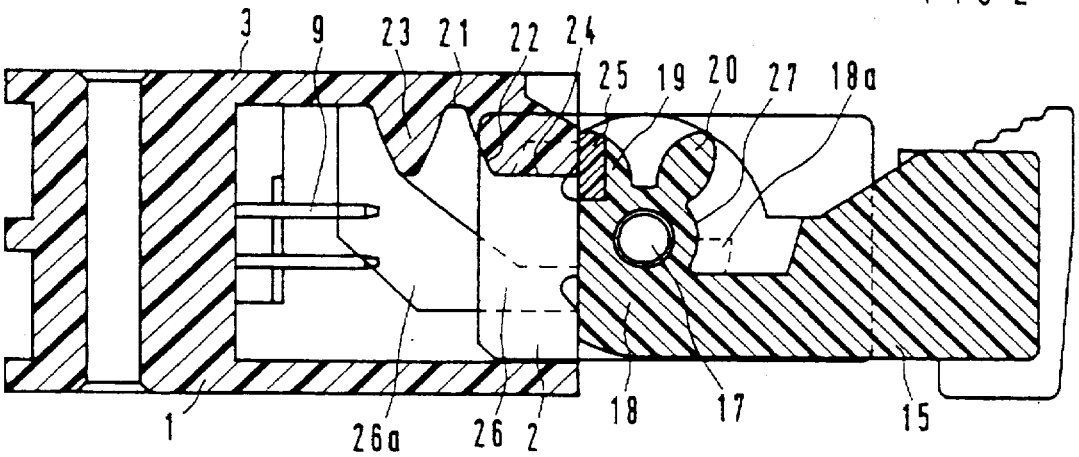

PLUG CONNECTOR HOUSING ASSEMBLY

BACKGROUND OF THE INVENTION

FIELD OF THE INVENTION

The invention relates to a plug connector housing assembly having an outer housing and an inner housing which can be nested together with approximately parallel opposed side walls, wherein on at least one side, between an inner wall surface of the outer housing and an opposite outer wall surface of the inner housing, a locking mechanism is provided in the form of a rack extending in a plug-in direction on one wall, and a gear wheel segment meshing with the rack and being firmly connected to a lever is provided on the other wall, and the gear wheel segment is supported rotatably on the wall about a shaft being perpendicular to the insertion direction.

A plug connector which is constructed in that way is fundamentally known from German Utility Model 87 14 016. With the aid of the gear wheel segment formed on a lever, in combination with the rack, it is possible, even at unfavorable installation locations, such as in a motor vehicle, to bring the requisite plug-in forces to bear, and for the two housing parts of the plug connector to be reliably inserted one into the other and locked in a final position. Since the lever can only be pivoted over a relatively slight angular range because of given structural conditions, and the gear wheel segment can then mesh with only one or two teeth of the rack, it is important for the pivoting range of the lever that is available to be fully utilized. In other words, it must be assured that at the onset of the plug-in motion, the lever has been swiveled all the way into the open position. Should that not be the case, and if the lever with the gear wheel segment, for instance, comes to mesh with the rack at an undefined intermediate position, then the remaining swiveling range is no longer sufficient to insert the inner housing all the way into the outer housing, and as a result the contacts are not closed, or are only incompletely closed. The danger also exists of the housing parts being put together while the lever with the gear wheel segment is already in the closing position, due to carelessness. It is then possible for the housing parts to be partly inserted into one another with the exertion of force, and for the teeth of the gear wheel segment and the rack to be deformed more or less, yet still not attain proper contact of the plug connector.

SUMMARY OF THE INVENTION

It is accordingly an object of the invention to provide a plug connector housing assembly, which overcomes the hereinafore-mentioned disadvantages of the heretofore-known devices of this general type and which assures that incorrect insertions or locking in an undefined intermediate position are avoided, through the use of a structural embodiment of the locking device.

With the foregoing and other objects in view there is provided, in accordance with the invention, a plug connector housing assembly, comprising an outer housing and an inner housing to be nested together in a plug-in direction; the housings including sides having approximately parallel opposed side walls with inner and outer surfaces; the side walls of the outer housing defining an insertion opening with a peripheral region; a locking mechanism in the form of a rack extending in the plug-in direction on one of the side walls; a lever associated with another of the side walls; a shaft being perpendicular to the plug-in direction and associated with the lever; a gear wheel segment meshing with the rack, being firmly connected to the lever on the other of the side walls and being rotatably supported on the other of the side walls about the shaft; the rack and the gear wheel segment being disposed at least at one of the sides, between the inner wall surface of the outer housing and the opposite outer wall surface of the inner housing; and the side wall carrying the rack in the peripheral region of the insertion opening, and the gear wheel segment, having complementary guide elements fitting into one another only at a predetermined angular position of the gear wheel segment in the plug-in direction, and preventing rotation of the gear wheel segment during engagement with the rack, until after attaining a predetermined insertion depth of the gear wheel segment.

Due to the additional guide elements which are provided according to the invention, at the peripheral regions of the two housing parts to be inserted into one another, it is accordingly assured that the threading-in at the beginning of the plug-in motion can take place only in a correct opening position of the lever and thus of the gear wheel segment.

In accordance with another feature of the invention, the additional guidance is attained in such a way that one housing wall forms a boundary strip in an extension of the rack, and the gear wheel segment has a radially recessed, toothless peripheral portion which is flush with the boundary strip, in an open position of the lever and of the gear wheel segment. This means that the teeth of the rack do not already begin at the open edge of the applicable housing but rather farther inward, and thus the gear wheel segment, with its teeth oriented more or less in the plug-in direction, must first be thrust inward past the boundary strip before rotation and engagement with the rack are possible.

In accordance with a further feature of the invention, the gear wheel segment has a lengthwise rib which increases its thickness in the axial direction and which in the open position of the lever extends in the insertion direction and is flush with a corresponding groove in the wall that carries the rack, and after the predetermined insertion depth, the groove widens in order to enable a rotation of the rib and of the gear wheel segment. In this embodiment as well, an alignment of the lever and the gear wheel segment is compelled at the beginning of the insertion motion in the open position of the lever. Since if the lever position is wrong, the guide elements already create a stop before the two housing parts are inserted into one another at all, this incorrect position is immediately apparent to the user, who will therefore not attempt to lock the housing parts in an incorrect position by exerting force.

Other features which are considered as characteristic for the invention are set forth in the appended claims.

Although the invention is illustrated and described herein as embodied in a plug connector housing assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a diagrammatic, exploded, perspective view of a plug connector housing assembly constructed according to the invention;

FIGS. 2–5 are more diagrammatic, fragmentary, sectional views through a locking device of a plug connector housing assembly in various positions of the locking device.

DESCRIPTION OF THE PREFERRED EMBODIMENTS

Figure 3:
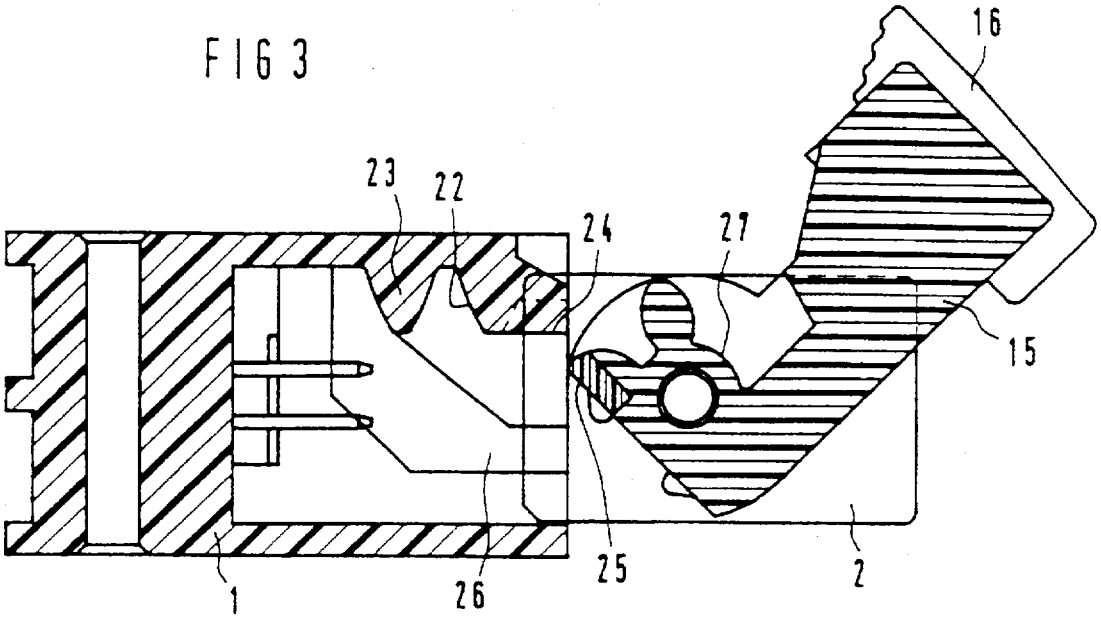
Figure 4:
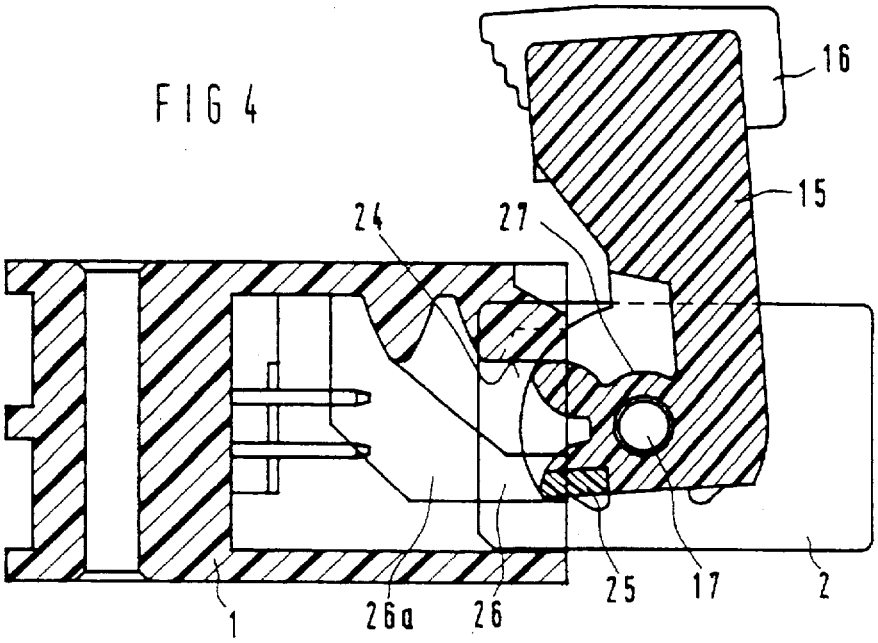

Referring now to the figures of the drawing in detail and first, particularly, to FIG. 1 thereof, there is seen a plug connector housing assembly which essentially includes a tub-shaped outer housing 1 and an inner housing 2 that can be inserted into it. The outer housing 1 has an insertion channel 8 of approximately rectangular cross section, which is defined by longitudinal side walls 3, 4 and transverse side walls 5, 6 and is closed off at an inner end thereof by a bottom 7. A multiplicity of plug pins 9, which are not visible in FIG. 1, protrude vertically from the bottom and are disposed, for instance, in two rows that are parallel to one another in a particular pattern, as is seen in FIG. 2. The inner housing 2 is equipped with non-illustrated plug receptacles for the plug pins and has a substantially rectangular cross section with longitudinal side surfaces 10, 11 and transverse side surfaces 12, 13, as well as a line feeder 14.

In order to connect the outer housing 1 and the inner housing 2 and take them apart, the inner housing 2 is provided with two levers 15 (only one of which is visible), which are joined together through a U-shaped hoop or bail 16 and are each supported on a shaft stub 17 protruding from the respective longitudinal side surface 10 and 11 of the inner housing 2. Ends of the two levers 15 that are supported on the shaft stub 17 each form a gear wheel segment 18 which is constructed as a central axis relative to the shaft stub 17, but the gear wheel segment has only two teeth 19 and 20.

In a manner corresponding to the gear wheel segments 18, which are supported rotatably on the outer longitudinal side surfaces 10 and 11 of the inner housing 2, the outer housing 1 has one rack attachment 21 on an inner surface of each of the longitudinal side walls 3 and 4. In the present example, these attachments 21 each include one and a half teeth, namely an inclined tooth surface 22 and one complete tooth 23. In order to connect the two housings 1 and 2, these housings are inserted into one another vertically as is shown in FIG. 1. The two levers 15 and the hoop or bail 16 assume a position of repose or opening position shown in FIG. 1 at the onset of the plug-in motion. It is not until after a certain insertion depth that the two levers 15 are pivoted counterclockwise, whereupon the teeth 19 and 20 mesh with the inclined tooth surface 22 and the tooth 23 of the rack 21 and in so doing draw the inner housing 2 all the way into the outer housing 1, so that the contact pins 9 are reliably contacted with the corresponding receptacles of the inner housing. To this extent, the general construction and the general function are also equivalent to the prior art. The special features of the invention will be described below, in terms of FIG. 2–6.

A section through a rack 21 of the outer housing and a lever 15 and a gear wheel segment 18 of the inner housing in various positions is shown in FIGS. 2–6. The general construction is simplified and shown more diagrammatically as compared with FIG. 1, in order to more clearly express the fundamental structural elements and functions. However, these fundamental function elements are identified by the same reference numerals as in FIG. 1, because they correspond to them in form and function.

Figure 6:
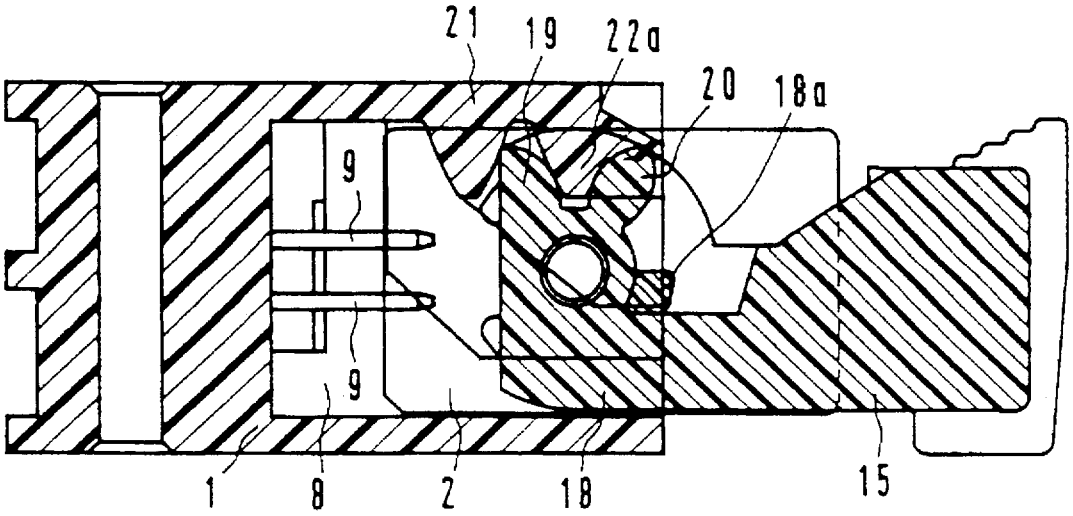
FIG. 6 is a fragmentary, sectional view corresponding to FIG. 5, of a plug connector housing assembly of the prior art which is locked incorrectly.

FIG. 6, which will be referred to first, shows a diagrammatic layout without the characteristics of the invention. In this case, the rack 21 is already constructed as a rack from the edge of the insertion channel 8 onward, and instead of just the inclined tooth surface 22, there is a more or less complete tooth 22*a* formed onto it. As a result, it is possible for the lever 15, with a gear wheel segment 18 which in this case also has a third tooth 18*a* in the form of an attachment, to be threaded into the rack 21 even in a position that does not correspond to the open position, but rather that forms a middle position between the opening and closing positions, for instance. The tooth 19 can then engage between the teeth 22*a* and 23, while the tooth 20, at the beginning of the rack, undergoes only slight penetration and readily deforms if only slight force is exerted on the lever 15. Thus the lever 15 reaches the closing position shown in FIG. 6, while the gear wheel segment 18, with its two teeth 19 and 20, meshes with only the beginning part of the rack 21, so that in the final position reached in this case, the contact pins 9 do not contact the corresponding receptacles of the inner housing 2. It is that situation which the invention intends to avoid.

In order to enlarge the blocked area if the lever 15 is positioned wrong, instead of the inclined surface pointing toward the housing opening of the rack tooth 22*a* as in FIG. 6, a boundary strip 24 seen in FIG. 2 is formed in an extension of a tooth apex. The gear wheel segment 18 has a radially recessed, toothless peripheral portion 27 being flush with the boundary strip 24 in an open position of the lever 15 and of the gear wheel segment 18. The result of this is that the rack 21 does not begin with the inclined tooth surface 22, until after an insertion depth, which is defined by the boundary strip 24. When the lever 15 is in a closing position as in FIG. 2, or a canted intermediate position, the teeth 19 and 20 cannot be introduced into the insertion channel 8. It is only in an open position of the lever 15 as in FIG. 4, that the gear wheel segment 18 is so narrow, as seen in the direction toward the rack, that insertion is possible. To that end, the third tooth or tooth attachment 18a seen in FIG. 6 is also no longer present on the gear wheel segment of the invention.

Figure 5:
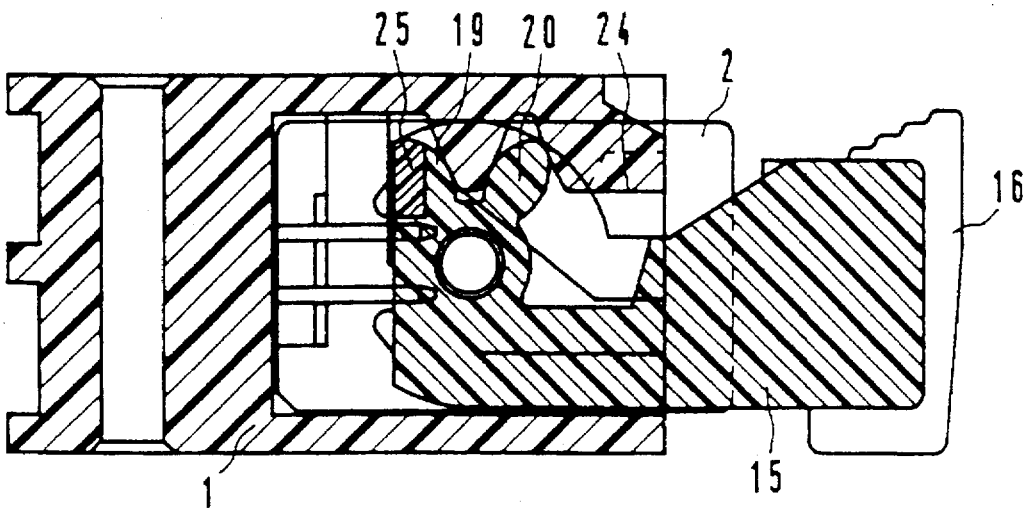

Further security against insertion in the wrong lever position is offered by a connecting link or guide rib 25, which is formed on the tooth 19 and increases the thickness of the gear wheel segment in the axial direction. This connecting link 25 corresponds to a connecting link guide 26 in the wall of the outer housing 1. The connecting link 25 accordingly strikes the edge of the insertion channel, if the lever 15 is in the closing position or in a canted intermediate position as in FIG. 3. The inner housing 2 can be introduced into the outer housing 1 only if the connecting link 25 plunges into the connecting link guide 26. This is possible only in the open position shown in FIG. 4. It is not until after a predetermined insertion depth that the connecting link guide 26 widens, in a region 26*a*, as a result of which a rotation of the gear wheel segment 18 and meshing of the teeth 19 and 20 with the inclined tooth surface 22 and the tooth 23 of the rack 21 become possible. As a result, the inner housing is drawn all the way into the outer housing 1, and contacting of the contact pins 9 takes place. This locked state is shown in FIG. 5.

We claim:

1. A plug connector housing assembly, comprising:

an outer housing and an inner housing to be nested together in a plug-in direction;

said housings including sides having approximately parallel opposed side walls with inner and outer surfaces;

said side walls of said outer housing defining an insertion opening with a peripheral region;

a locking mechanism in the form of a rack extending in the plug-in direction on one of said side walls;

a lever associated with another of said side walls;

a shaft being perpendicular to the plug-in direction and associated with said lever;

a gear wheel segment meshing with said rack, being firmly connected to said lever on said other of said side walls and being rotatably supported on said other of said side walls about said shaft;

said rack and said gear wheel segment being disposed at least at one of said sides, between said inner wall surface of said outer housing and said opposite outer wall surface of said inner housing; and said side wall carrying said rack in said peripheral region of said insertion opening, and said gear wheel segment, having complementary guide elements fitting into one another only at a predetermined angular position of said gear wheel segment in the plug-in direction, and preventing rotation of said gear wheel segment during engagement with said rack, until after attaining a predetermined insertion depth of said gear wheel segment;

a) said rack disposed on said wall of the outer housing having a first tooth of said rack being operative for opening the housing, and a boundary strip extending to the edge of said insertion channel formed in said first tooth;

b) said gear wheel segment having a radially recessed toothless peripheral portion aligned with said boundary strip in an open position of said lever;

c) said gearwheel segment having a guide rib extending in said plug-in direction of said inner housing when said lever is in its open position;

d) said side wall of the outer housing having on its inside a connecting link guide disposed in alignment with said guide rib when said lever is in its open position; and e) wherein said link guide includes a widening region for enablingly receiving said guide rib upon turning said guide rib after reaching said predetermined insertion depth of said inner housing.

2. The plug connector housing assembly according to claim 1, wherein one of said housing walls has a boundary strip in an extension of said rack, and said gear wheel segment has a radially recessed, toothless peripheral portion being flush with said boundary strip in an open position of said lever and of said gear wheel segment.

3. The plug connector housing assembly according to claim 1, wherein said gear wheel segment has a lengthwise rib with a thickness being increased in axial direction, is extended in the plug-in direction in an open position of said lever and is flush with a corresponding groove formed in said housing wall carrying said rack, and said groove widens for enabling rotation of said rib and of said gear wheel segment, after attaining said predetermined insertion depth.

4. The plug connector housing assembly according to claim 1, including another locking mechanism, another lever, and a hoop joining said levers, each of said locking mechanisms and said levers being disposed on a respective one of two of said opposed housing side walls.

* * * * *